US006660405B2

(12) United States Patent
Lau et al.

(10) Patent No.: US 6,660,405 B2
(45) Date of Patent: Dec. 9, 2003

(54) HIGH TEMPERATURE ABRADABLE COATING FOR TURBINE SHROUDS WITHOUT BUCKET TIPPING

(75) Inventors: Yuk-Chiu Lau, Ballston Lake, NY (US); Farshad Ghasripoor, Scotia, NY (US); Dennis M. Gray, Delanson, NY (US); Chek Beng Ng, Albany, NY (US)

(73) Assignee: General Electric Co., Schenectady, NY (US)

( * ) Notice: Subject to any disclaimer, the term of this patent is extended or adjusted under 35 U.S.C. 154(b) by 211 days.

(21) Appl. No.: 09/863,760

(22) Filed: May 24, 2001

(65) Prior Publication Data

US 2003/0054196 A1 Mar. 20, 2003

(51) Int. Cl.[7] ..... B32B 5/18; B32B 15/01; B32B 15/20; C23C 4/06

(52) U.S. Cl. ..... 428/613; 428/652; 428/678; 428/680; 428/681; 427/455

(58) Field of Search ..... 428/613, 652, 428/565, 678, 680, 681; 427/455

(56) References Cited

U.S. PATENT DOCUMENTS 3,918,925 A * 11/1975 McComas ..... 428/550
4,299,865 A * 11/1981 Clingman et al. ..... 427/243
4,336,276 A * 6/1982 Bill et al. ..... 427/447
4,540,336 A * 9/1985 Cawley ..... 415/173.4
4,764,089 A * 8/1988 Strangman ..... 415/173.4
4,936,745 A * 6/1990 Vine et al. ..... 415/173.4
5,196,471 A 3/1993 Rangaswamy et al.
5,262,206 A 11/1993 Rangaswamy et al.
5,434,210 A 7/1995 Rangaswamy et al.
5,530,050 A 6/1996 Rangaswamy
5,780,171 A * 7/1998 Nissley et al. ..... 428/629
5,951,892 A * 9/1999 Wolfla et al. ..... 219/121.69
6,190,124 B1 * 2/2001 Freling et al. ..... 415/173.4

* cited by examiner

*Primary Examiner*—John J. Zimmerman
*Assistant Examiner*—Jason L Savage
(74) *Attorney, Agent, or Firm*—Nixon & Vanderhye P.C.

(57) ABSTRACT

An abradable coating composition for use on shrouds in gas turbine engines (or other hot gas path metal components exposed to high temperatures) containing an initial porous coating phase created by adding a "fugitive polymer" (such as polyester or polyimide) to the base metal alloy, together with a brittle intermetallic phase such as β-NiAl that serves to increase the brittle nature of the metal matrix, thereby increasing the abradability of the coating at elevated temperatures, and to improve the oxidation resistance of the coating at elevated temperatures. Coatings having about 12 wt % polyester has been found to exhibit excellent abradability for applications involving turbine shroud coatings. An abradable coating thickness in the range of between 40 and 60 ml provides the best performance for turbine shrouds exposed to gas temperatures between 1380° F. and 1850° F. Abradable coatings in accordance with the invention can be used for new metal components or to repair existing equipment.

12 Claims, 6 Drawing Sheets

Figure 1: Comparison With Prior Art Systems

Example of abradable coating designations: "F1220" =Fine β-NiAl (-325+20μm); 12wt% Polyester (SM600NS); 20 % β-NiAl in metal phase

HIGH TEMPERATURE ABRADABLE COATING FOR TURBINE SHROUDS WITHOUT BUCKET TIPPING

BACKGROUND OF THE INVENTION

The present invention relates to coatings applied to metal components of gas turbine engines, radial inflow compressors and radial turbines, including micro-turbines and turbochargers, that are exposed to high temperature environments and, in particular, to a new type of abradable coating applied to turbine shrouds used in gas turbine engines in order to improve the performance and efficiency of the turbine blades (also known as "buckets"). Although the present invention has been found particularly useful in stage 1 turbine shrouds, the same coating developments can be used in other stages of gas turbine engines, as well as on hot gas path metal components of other rotating equipment exposed to high temperature environments. The present invention can also be used to repair and/or replace the coatings on metal components already in service, such as coated turbine shrouds.

Gas turbine engines are used in a wide variety of different applications, most notably electrical power generation. Such engines typically include a turbocompressor that compresses air to a high pressure by means of a multi-stage axial flow compressor. The compressed air passes through a combustor which accepts air and fuel from a fuel supply and provides continuous combustion, thus raising the temperature and pressure of the working gases to a high level. The combustor delivers the high temperature gases to the turbine, which in turn extracts work from the high pressure gas working fluid as it expands from the high pressure developed by the compressor down to atmospheric pressure.

As the gases leave the combustor, the temperature can easily exceed the acceptable temperature limitations for the materials of construction in the nozzles and buckets in the turbine. Although the hot gases cool as they expand, the temperature of the exhaust gases normally remains well above ambient. Thus, extensive cooling of the early stages of the turbine is essential to ensure that the components have adequate life. The high temperature in early stages of the turbine creates a variety of problems relating to the integrity, metallurgy and life expectancy of components coming in contact with the hot gas, such as the rotating buckets and turbine shroud. Although high combustion temperatures normally are desirable for a more efficient engine, the high gas temperatures may require that air be taken away from the compressor to cool the turbine parts, which tends to reduce overall engine efficiency. One aim of the present invention is to enable the stationary shroud to cope with the high gas temperatures without having to increase cooling air.

In order to achieve maximum engine efficiency (and corresponding maximum electrical power generation), it is also important that the buckets rotate within the turbine housing or "shroud" without interference and with the highest possible efficiency relative to the amount of energy available from the expanding working fluid.

During operation, the turbine housing (shroud) and a portion of the hub remain fixed relative to the rotating buckets. Typically, the highest efficiencies can be achieved by maintaining a minimum threshold clearance between the shroud and the bucket tips to thereby prevent unwanted "leakage" of gas over or around the tip of the buckets. Increased clearances will lead to leakage problem can cause significant decreases in overall efficiency of the gas turbine engine. Only a minimum amount of "leakage" of the hot gases at the outer periphery of the buckets, i.e., the small annular space between the bucket tips and turbine housing, can be tolerated without sacrificing engine efficiency.

The need to maintain adequate clearance without significant loss of efficiency is made more difficult by the fact that as the turbine rotates, centrifugal forces acting on the turbine components can cause the buckets to expand radially in the direction of the shroud, particularly when influenced by the high operating temperatures. Thus, it is important to establish the lowest effective running clearances between the shroud and bucket tips at the maximum anticipated operating temperatures.

A significant loss of gas turbine efficiency can also result from wear of the bucket tips if, for example, the shroud is distorted or the bucket tips rub against the shroud creating metal-to-metal contact. Again, any such deterioration of the buckets at the interface with the shroud when the turbine rotates will eventually cause significant reductions in overall engine performance and efficiency.

In the past, abradable type coatings have been applied to the turbine shroud to help establish a minimum, i.e., optimum, running clearance between the shroud and bucket tips under steady-state temperature conditions. In particular, coatings have been applied to the surface of the shroud opposite the buckets using a material that can be readily abraded by the tips of the buckets as they turn inside the housing at high speed with little or no damage to the bucket tips. Initially, a small clearance exists between the bucket tips and the coating when the gas turbine is stopped and the components are at ambient temperature. Later, during normal operation, the centrifugal forces and increased heat generated by the system inevitably results in at least some radial extension of the bucket tips, causing them to contact the coating on the shroud and wear away a part of the coating to establish the minimum running clearance. As detailed below, the relationship between the type of material used to form the abradable coating and the temperature of the turbine shroud can play a critical role in the overall efficiency and reliability of the entire engine. Without abradable coatings, the cold clearances between the bucket tips and shroud must be large enough to prevent contact between the rotating bucket tips and the shroud during later high temperature operation. With abradable coatings, on the other hand, the cold clearances can be reduced with the assurance that if contact occurs, the sacrificial part will be the abradable coating and not the bucket tip.

As noted in prior art patents describing abradable coatings for use in turbocompressors and gas turbines (see e.g., U.S. Pat. No. 5,472,315), a number of design factors must be considered in selecting an appropriate material for use as an abradable coating on the shroud, depending upon the coating composition, the specific end use, and the operating conditions of the turbine, particularly the highest anticipated working fluid temperature. Ideally, the cutting mechanism (e.g., the bucket blade tips) can be made sufficiently strong and the coating on the shroud will be brittle enough at high temperatures to be abraded without causing damage to the bucket tips themselves. That is, at the maximum operating temperature, the shroud coating should be preferentially abraded in lieu of any loss of metal on the bucket tips.

Thus, the need exists for an abradable coating system that will allow for the use of bucket tips at elevated temperatures without requiring any tip reinforcement (such as the application of aluminum oxide and/or abrasive grits such as cubic boron nitride). A need also exists for an improved abradable coating system that can be used if necessary in conjunction with reinforced bucket tips in order to provide even longer term reliability and improved operating efficiency.

In addition, any coating material that is removed (abraded) from the shroud should not affect downstream engine components. The abradable material must also be securely bonded to the turbine shroud and remain bonded while portions of the coating are removed by the bucket blades during startup, shut-down or a hot-restart. Preferably, the abradable coating material remains bonded to the shroud for the entire operational life of the gas turbine and does not significantly degrade over time. Ideally, the coating should also remain secured to the shroud during a large number of operational cycles, that is, despite repeated thermal cycling of the gas turbine engine during startup and shutdown, or periodic off-loading of power.

Another critical design factor that must be considered in the context of abradable shroud coatings concerns the rate of degradation of the coating due to exposure to hot gases containing oxygen over long periods of time at elevated temperatures. Many prior art coatings require bucket tip reinforcement, particularly in higher temperature applications. As the gas temperature increases, coating structures become more and more ductile and the increased ductility tends to reduce the ability of the coating to be abraded. Thus, most of the prior art coatings use higher levels of porosity to compensate for the increased ductility. However, the higher porosity also tends to reduce the life span of the prior art coatings at high temperatures because the same porosity volume that make the coatings less ductile also renders them much more vulnerable to oxidation, particularly in the earlier turbine stage conditions.

In the past, a number of abradable coatings have been suggested for use on compressor shrouds and other gas turbine components. The coatings in U.S. Pat. Nos. 3,346,175; 3,574,455; 3,843,278; 4,460,185 and 4,666,371 represent a few well known abradable coatings that have been used with some success on metal shrouds. However, these conventional coatings are not sufficiently durable or resistant to oxidation in much higher temperature environments. Thus, the prior art coatings tend to oxidize, delaminate or even separate from the shroud substrate as the turbine undergoes thermal cycling during startup and shut down.

Over the past twenty years, considerable research and development work has been done (including by General Electric) in the field of high temperature coatings to solve these known abradability and oxygen-resistance problems. The result has been an increase in the capability of the coatings to resist degradation over long periods of time.

The problems of abradability and oxygen resistance for turbine shrouds remain, however, and have become more pronounced in recent times because of the desire to use even higher operating temperatures in gas turbine engines to thereby increase their working efficiency. As the operating temperatures go up, the durability of the engine components must correspondingly increase. One known shroud coating available commercially utilizes a metallic layer formed from an oxidation-resistant alloy known as "MCrAlY" in combination with a polymer material, such as polyester or polyimide (used to impart porosity), where "M" can be iron, cobalt and/or nickel.

Another recognized improvement in shroud coatings for mid- to high temperature applications uses a thermal barrier coating in addition to an abradable top coating. Such thermal barriers can be formed of various non-porous materials including alloys and ceramics such as zirconia stabilized by an oxide material or MCrAlY, where "M" consists of iron, cobalt or nickel.

BRIEF SUMMARY OF THE INVENTION

The present invention concerns a high temperature abradable coating system for turbine shrouds that is much more effective than conventional prior art systems, both as an abradable coating and as an oxidation-resistant component, particularly at operating temperatures above 1400° F. The coatings in accordance with the invention also provide close clearance control between the bucket tips and shroud, and thereby reduce hot gas leakage and improve overall gas turbine efficiency.

The coatings in accordance with the invention are much more effective in controlling oxidation than the current state of the art coatings, such as Sulzer Metco SM2043 which consists of MCrAlY together with 15 wt % polyester and 4 wt % boron nitride (hBN). See U.S. Pat. No. 5,434,210. The MCrAlY component of the SM2043 nominally contains CO25Ni16Cr6.5Al0.5Y and is recommended for applications up to approximately 1380° F. without tipped (uncoated) buckets and 1560° F. for tipped buckets. Because the SM2043 material does not abrade well above 1380° F., it can result in non-uniform wear of the shroud coating and/or cause damage to the bucket tips themselves by the rotational impact of the bucket with the shroud metal, ultimately requiring some type of tip reinforcement or coating.

In addition, because of the high porosity in coatings using Sulzer Metco SM2043, the oxidation life of such coatings is relatively short at operating temperatures above 1580° F. For example, the SM2043 coatings begin to show poor oxidation resistance at temperatures above 1380° F. and the resistance level deteriorates significantly above that temperature, with many coatings lasting only a few hours at temperatures approaching the level of earlier turbine stages (1700° F.). The poor oxidation resistance of these prior art compositions is attributable to the relatively high porosity levels (about 55% by volume) in the abradable top coat and to the poor oxidation resistance of CoNiCrAlY in such high temperatures. The high coating porosity tends to allow a much higher rate of ingress of oxygen into the coating.

Thus, a significant need exists in the art for an abradable coating for gas turbine shrouds operating at higher than average temperatures, i.e., above 1380° F., which is capable of achieving a longer oxidation life, preferably up to 24,000 hours, when used at gas temperatures in the 1600–1850° F. range. There is also a significant need for improved abradable coatings capable of ensuring that the turbine buckets suffer from only minimal wear during startup and shutdown due to radial expansion and contraction. There is also a need to provide an abradable coating that will avoid the necessity for tipped blades which might otherwise be required due to the non-abradable nature of coatings in the higher temperature ranges of turbine shrouds. Finally, a need exists to provide a coating that will have sufficient erosion resistance over the life of the gas turbine equipment, thereby avoiding the need to interrupt operation to maintain and/or replace the turbine coating.

It has now been found that the above requirements for an improved abradable metallic coating system in turbine shrouds can be satisfied by using a coating containing the following basic components:

1. A "fugitive" polymer or other plastic phase (such as polyester or polyimide) which can then be burned off without leaving any residue or ash to create a porous coating. The porosity level can then be optimized for maximum abradability and oxidation life. As detailed below, a coating having about 12 wt % polyester has been found to exhibit excellent abradability for applications involving turbine shroud coatings. It has also been found that abradable coating thickness in the range of between 40 and 60 mils will provide the best performance for turbine shrouds exposed to gas temperatures between 1380° F. and 1850° F.

2. A metallic oxidation-resistant matrix phase such as CoNiCrAlY, e.g., Praxair Co211 (Co32Ni21Cr8Al0.5Y), NiCoCrAlY, FeCrAlY or NiCrAlY, e.g., Praxair Ni211 (Ni22Cr10Al1Y); and
3. A brittle intermetallic phase, such as β-NiAl (68.51 wt % Ni and 31.49 wt % Al), or an intermetallic phase former that serves to increase the brittle nature of the metal matrix and thereby increase the abradability of the coating at elevated temperatures. The use of this third phase also significantly improves oxidation resistance at high temperature without adversely affecting abradability.

Abradable coatings using components (1) and (3) above have been found particularly useful for E-Class, land-based shrouds and other applications where the buckets are not normally tipped (coated) and the shroud is exposed to high operating temperatures at or near 1700° F.

Coatings in accordance with the above three basic components can be applied to both new and used turbine shrouds in gas turbine engines using conventional techniques (such as plasma spray), or to other hot gas path metal components of rotating equipment exposed to high temperatures. For example, the coatings on existing gas turbine engine shrouds can be physically removed after the equipment is taken out of service for repair or routine maintenance, with the new coatings then being applied using conventional high level bonding and coating techniques known to those skilled in the art.

DETAILED DESCRIPTION OF THE INVENTION

Figure 1:
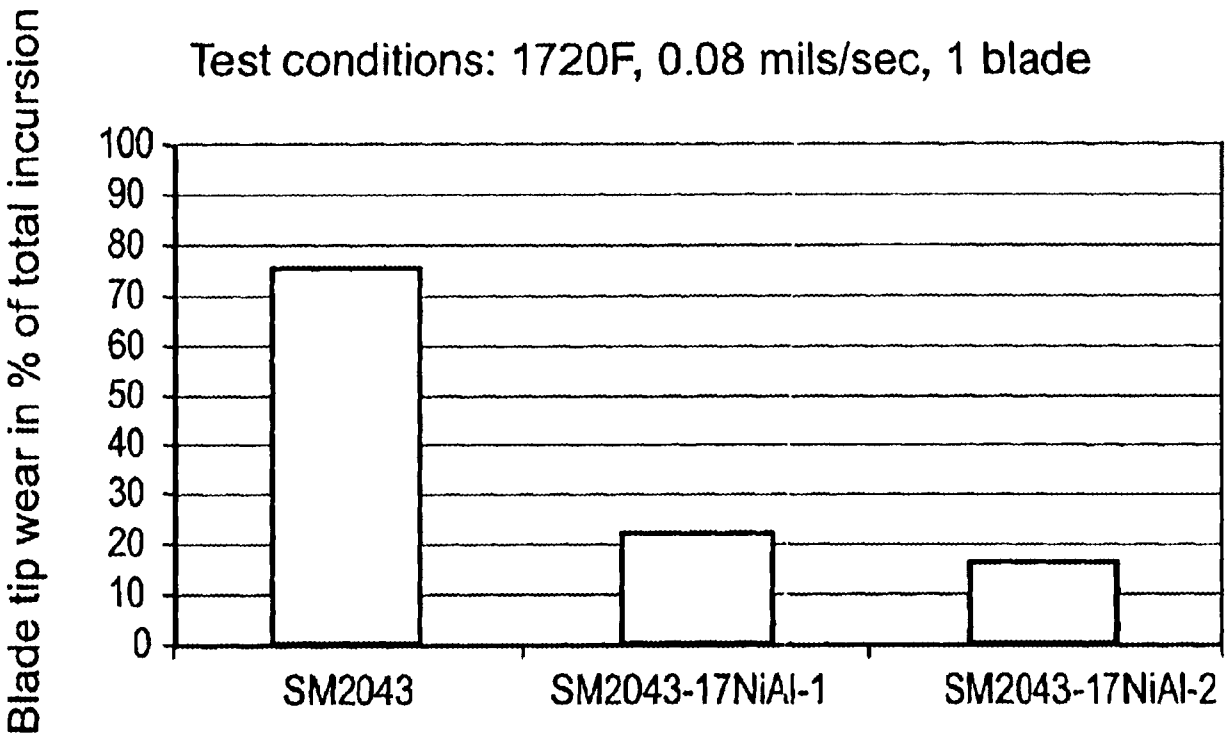
FIG. 1 is a comparison chart showing the relative differences in blade tip wear for systems using conventional prior art abradable coatings on the shroud as compared to coatings formed from compositions according to the invention.

As noted above, the preferred embodiment of the present invention involves a unique balance of two competing coating properties, namely (1) abradability and (2) oxidation resistance. Abradable coatings according to the invention having components (1), (2) and (3) above exhibit improved abradability at high temperature, primarily as a result of the combination of MCrAlY, β-NiAl and a polymer such as polyester as the fugitive polymer to create the desired level of porosity for abradability. The preferred compositions thus use a lower level of polyester additive than conventional coatings, i.e., in the range of about 12% by weight.

Thus, an important design feature of the present invention involves the use of compositions exhibiting increased brittleness (and thus improved abradability) at the higher operating temperatures. The increase in brittleness is achieved without a measurable increase in porosity of the abradable coating. That is, it has now been found that the addition of β-NiAl (component (3)) identified above) to conventional MCrAlY and polyester mixtures under controlled conditions tends to create a unique balance of physical and metallurgical properties of the applied coatings, namely lower porosity (and hence better oxidation resistance) with improved abradability at temperatures in the range of 1380° F. to 1800° F. The addition of β-NiAl also improves the high temperature oxidation resistance of the coating because it has significantly higher oxidation resistance than MCrAlY at high temperatures.

In an alternative embodiment of the present invention, components (1) and (3) can be used alone, i.e., omitting element (2), to form the abradable coating composition. That is, the initial porous coating phase is combined only with the brittle metallic and/or inter-metallic phase without component (2). In yet another embodiment, multiple layers of both abradable and dense (non-porous) bond coats can be applied to the turbine shroud in succession, with the dense bond coat being applied in an initial process. A first non-porous, metallic oxidation resistant metal coating comprised of MCrAlY such as CoNiCrAlY, NiCoCrAlY, FeCrAlY or NiCrAlY is adhered to the shroud, followed by a separate layer of an abradable coating comprising one of the two systems described above, i.e., containing components (1), (2) and (3) or alternatively components (1) and (3). The dense bond coat layer provides additional oxidation resistance and can be applied to the shroud using convention means, such as by thermal spray processes such as APS (air plasma spray), HVOF (hyper velocity oxy-fuel) or LPPS (low pressure plasma spray) processes.

As a still further embodiment, a solid lubricant phase such as hexagonal boron nitride (hBN) can be added to the coating system to promote abradability. However, because the solid lubricant phase may not be stable at higher operating temperatures, it may not be necessary to add hBN in high temperature environments. For lower temperature applications, such as compressor blades, the hBN component should be included.

One exemplary high temperature abradable coating system in accordance with the present invention appears below in Table 1 below:

TABLE 1

| | Starting wt, lb | Polyester wt % | HBN wt % | MCrAlY wt % | β-NiAl wt % |
|---|---|---|---|---|---|
| Sulzer Metco SM2043 | 5.0 | 15 | 4 | 81 | |
| β-NiAl | 1.0 | | | | 100 |
| SM2043-17NiAl | 6.0 | 12.5 | 3.3 | 67.5 | 16.7 |

Table 1 illustrates the basic components used to form compositions according to the invention as described above, e.g., using Sulzer Metco SM2043 (which contains MCrAlY with 15 wt % polyester and 4 wt % boron nitride) combined with a brittle intermetallic phase, β-NiAl of powder size of −200 +20 μm, in an effective amount of 16.7 wt %. The powders were mechanically blended for plasma spraying. Upon rub testing, abradable coatings using these two primary components showed better abradability at turbine temperatures when compared to conventional SM2043. Table 1 also indicates that by adding β-NiAl to the Sulzer Metco SM2043, the polyester wt % and coating porosity level necessarily becomes reduced. The net reduction in porosity, coupled with the addition of β-NiAl, has a combined positive impact on oxidation life (see FIG. 2 below).

Table 2 below summarizes the spray parameters used to apply abradable coatings to a turbine shroud in accordance with the invention, including coatings containing the basic components identified in Table 1. As Table 2 indicates, a plasma gun can be used to deposit the coatings using a range of spray parameters. In all cases, the applied abradable coating thickness was 0.040 inch.

TABLE 2

Spray parameters for metallic abradable coatings.

| | Range of Parameters |
|---|---|
| GUN MFR./MODEL NO.: | METCO 7MB |
| NOZZLE (ANODE NO.): | 732/GH |
| ELECTRODE (CATHODE NO.): | 9MB63 |
| GAS INJECTOR: | 9MB50/Argon |
| Powder Port: | #1 |
| ARC GAS SETTINGS | |
| Primary Gas Type: | Argon |
| flow: +/−1% CFH | 105–115 |
| SECONDARY GAS TYPE: | Hydrogen |
| FLOW: CFH | 2–30 |
| POWER SETTINGS | |
| Voltage: V | 60–65 |
| Current: A | 400–550 |
| POWDER FEED EQUIPMENT & SETTINGS | |
| POWDER FEED RATE (LBS/HR): | 5–7 |
| CARRIER GAS FLOW (CFH): +/−1 | 9–12 |
| COATING DATA | |
| STAND OFF DISTANCE: in | 3–6 |
| GUN SPEED, mm/sec | 500–800 |

In order to evaluate the level of abradability of coatings formed in accordance with the invention and determine the preferred thickness of coatings, a number of standard rub tests were conducted to evaluate the degree of abradability at test temperatures between 1400° F. and 1720° F. Based on currently available data, the preferred coating thickness for abradable compositions ranges between 40 and 60 mils. Table 2 also reflects the preferred operating ranges for other spray parameters used for metallic abradable coatings in accordance with the invention.

FIG. 1 shows the results of rub tests on Sulzer Metco SM2043 coatings at 1720° F. as compared to the abradable coatings covered by the invention using the following protocol: The velocity of the rotating shroud is 376 meters/second (1234 ft/second); the incursion rate of the blade was 2 μm (0.08 mils) per second; the blade tip thickness was set at 3 mm (0.125 inches) and the target incursion depth was +0.8 mm (32 mil)

The FIG. 1 data confirms that coatings consisting of Sulzer Metco SM2043 alone do not perform as well as coatings in accordance with the invention. For example, the results for the coatings labeled "SM2043–17NiAl (Metco para)-1" and "SM2043-17NiAl (Metco para)-2" show significantly lower percentages of blade tip wear during the rub test than the conventional Sulzer Metco SM2043 coatings. The rub test procedure used to generate the data of FIG. 1 is summarized below:

Rub Test Procedure

The test rig consists of a rotor (disk), movable specimen (shroud) stage and a heating device (gas burner). Up to 6 simulated buckets may be mounted on the rotating disk. Bucket tip surface velocities ranging between 650–1300 ft/sec can be achieved by rotating the disk. The shroud is heated by means of a gas burner and the shroud surface temperature is calibrated using a number of thermocouples. The burner flame intensity is adjusted by means of valves that respond to gas mass flow meters controlling the fuel gas and oxygen. The shroud surface temperature is then varied by changing flame intensity as well as the addition of compressed air (providing surface film cooling). Rotating the disk at about 9090 rpm provides a bucket tip surface velocity of about 1230 ft/sec. This velocity represents the average operating speed of the bucket tips in the E-class gas turbine.

After reaching steady state conditions for the tip velocity and shroud surface temperature, the shroud is moved towards and into the path of the rotating bucket tips at a pre-set velocity and a pre-set depth. This movement simulates a typical interaction between rotating buckets and the shroud in the gas turbine, cutting a trench into the abradable coating. The pre-set velocity represents the rate at which this interaction occurs, in this case 0.08 mils/s. Following the completion of the pre-set cut, the shroud is retracted away from the rotating buckets.

The depth of cut into the coating and any bucket tip wear is then measured and compared to pre test values. A high speed data acquisition system allows monitoring and collection of data such as the temperature, vibration caused by cutting, rpm and incursion rate throughout the test.

Table 3 below reflects the results of oxidation tests performed on abradable high temperature coatings in accordance with the invention and shows the total amount of the β-NiAl present in the coatings being evaluated, as well as varying amounts of polyester, β-NiAl and MCrAlY. The purpose of the comparative examples in Table 3 was to determine a preferred range of the amount of polyester necessary to create the desired level of porosity and abradability of the coating, as well as the corresponding preferred range of β-NiAl necessary to improve the oxidation life of the coatings. Together, the MCrAlY and -NiAl form the "metallic component" of the coatings under consideration. In Table 3, the coating designation term "C975" means 9 wt % polyester (Metco 600NS) with 75% β-NiAl (where C=coarse size eof −200+20 μm) and 25% MCrAlY in the metallic component of the coating. The term "F9100" means 9 wt % polyester (Metco 600NS) with 100% β-NiAl (where F=fine size of −325+20 μm in the metallic component of the coating).

TABLE 3

| Designation | wt % PE | Metallic component % β-NiAl | % MCrAlY | wt % Al |
|---|---|---|---|---|
| SM2043 | 15 | 0 | 100 | 5.7 |
| SM2043-17NiAl | 12 | 20 | 80 | 9.7 |
| C975 | 9 | 75 | 25 | 22.1 |
| F9100 | 9 | 100 | 0 | 27.3 |
| F620 | 6 | 20 | 80 | 10.9 |
| C675 | 6 | 75 | 25 | 22.8 |
| F6100 | 6 | 100 | 0 | 28.2 |

Table 4 below summarizes the results of the oxidation tests performed on coating compositions according to the invention to determine their relative resistance to oxidation within the range of high temperatures anticipated for turbine shroud applications. The coating compositions were subjected to static oxidation tests at temperatures of 1600° F., 1800° F., 1900° F., 2000° F. and 2100° F. The numbers in emboldened italic in Table 4 indicate coating samples that had not yet failed even after the number of indicated hours at the designated temperature as of May 8, 2001. The numbers in italic reflect the time of failure in hours due to the presence of coating cracks.

TABLE 4

Oxidation Test Results
Numbers = hours in isothermal oxidation soak

| Temperature (F.) | SM2043 | SM2043-17 NiAl | F6100 | C675 | F620 | C975 |
|---|---|---|---|---|---|---|
| 2100 | *4* | *6* | *256* | *169* | *32* | *50* |
| 2000 | *12* | *16* | ***830*** | ***805*** | *140* | *261* |
| 1900 | X | X | ***950*** | ***950*** | X | ***692*** |
| 1800 | *150* | *191* | ***210*** | ***210*** | ***1957*** | ***210*** |
| 1600 | *1101* | *1437* | X | X | ***2197*** | X |

The italicized numbers indicate failure due to coating cacks.
The emboldened numbers in italics indicate samples that had not failed as of May 8, 2001.
"X" indicates no oxidation test was done.

Based on the empirical oxidation data known to table 4), the oxidation life for compositions in accordance with the invention can be determined according to the following regression formula:

$$\text{Oxidation life} = \exp(32.1 - 0.958*PE + 0.0274*NiAl - 0.0117*T + 0.03357*PE^2)$$

Where Oxidation life=number of hours until the development of coating cracks; PE=wt % polyester in the coating; NiAl=wt % β-NiAl in the metallic component of the coating, with the balance being MCrAlY; and T=test temperature in degrees F.

As those skilled in the art will appreciate, the above empirical regression formula defines the oxidation life as a function of the temperature of the turbine engine stage and the specific coating chemistry used on the abradable coatings. The gas temperature will differ slightly from the surface temperature of the shroud because the situation is not isothermal, in contrast to the oxidation tests discussed above where the condition is isothermal. The above regression formula can be used to predict an oxidation life curve for a wide variety of different coatings. As one example, a typical oxidation plot (see FIG. 2, entitled "Oxidation Projection") shows an exemplary coating containing 12% polyester and 88% metallic component (66% MCrAlY and 22% β-NiAl) where the MCrAlY represents 75% of the combined metal weight (hence the designation "1275" in FIG. 2).

Figure 2:
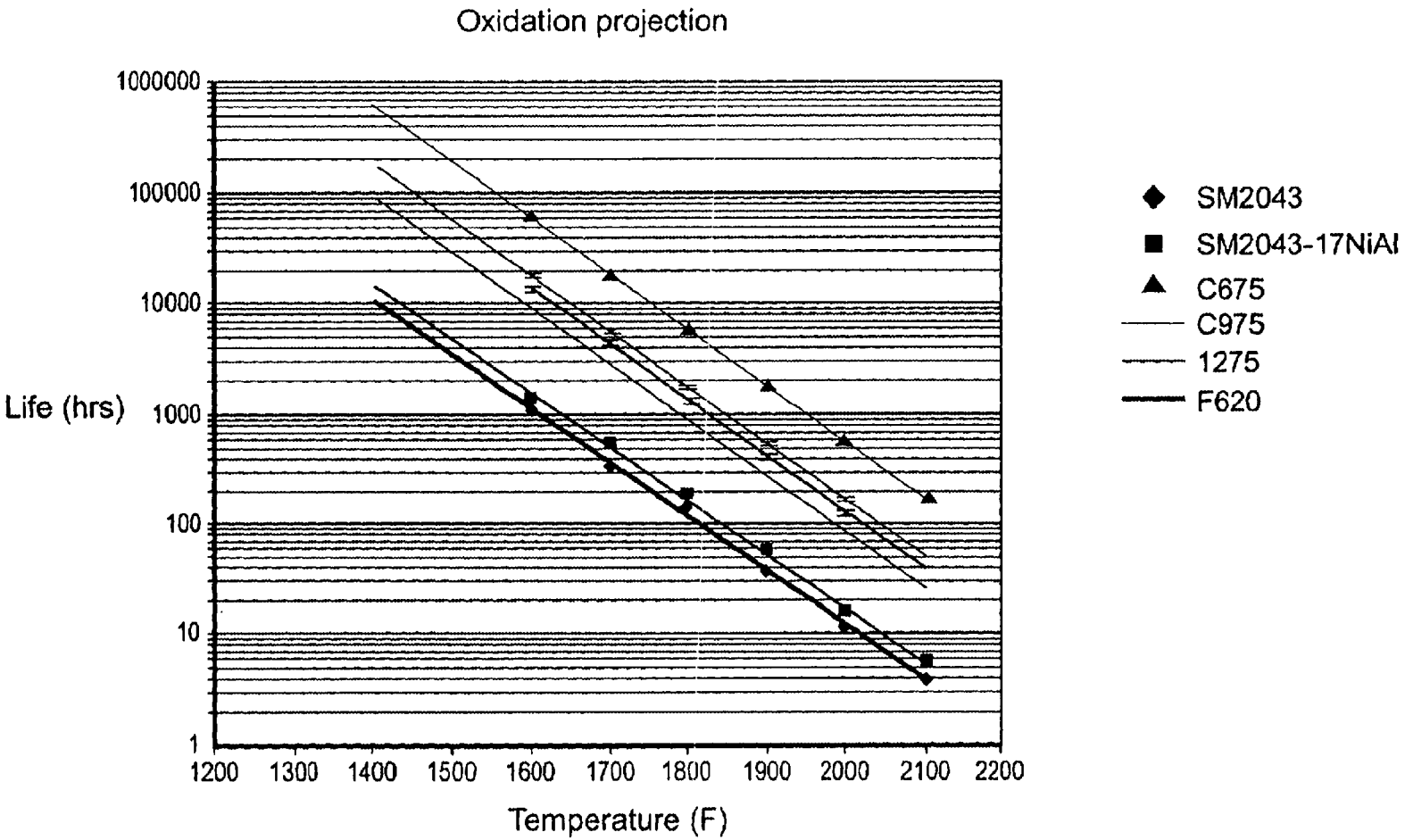
FIG. 2 is an "Oxidation Projection" graph, again comparing prior art abradable coating systems with compositions according to the invention.

Based on empirical data available to date (and as reflected in FIG. 2), the new 1275 coating composition has a predicted life of 15,000 hours at 1540° F., which represents a dramatic improvement over the conventional Sulzer Metco SM2043 coating used as a control (and identified in FIG. 2 as "SM2043").

In order to demonstrate some of the problems encountered with prior art abradable coating structures, a conventional Sulzer Metco coating (Sulzer Metco SM2043) has also been tested. The coating comprised Co25Ni16Cr6.5Al0.5Y with 15 weight percent polyester and 4 wt. % boron nitride, but without any β-NiAl being added. The polyester component was burned off using the following standard procedure to create the desired porosity level necessary for good abradability up to 1380° F.

Polyester Burn out Procedure

The simulated shroud containing the abradable coating applied to the top surface is placed in the furnace at ambient temperature. The furnace is then heated to approximately 850° F. at a rate of 12° F./min. The blade tip is kept at this temperature for at least 4.5 hours and then furnace cooled. The entire cycle could take as long as 8 hours.

Figure 3:
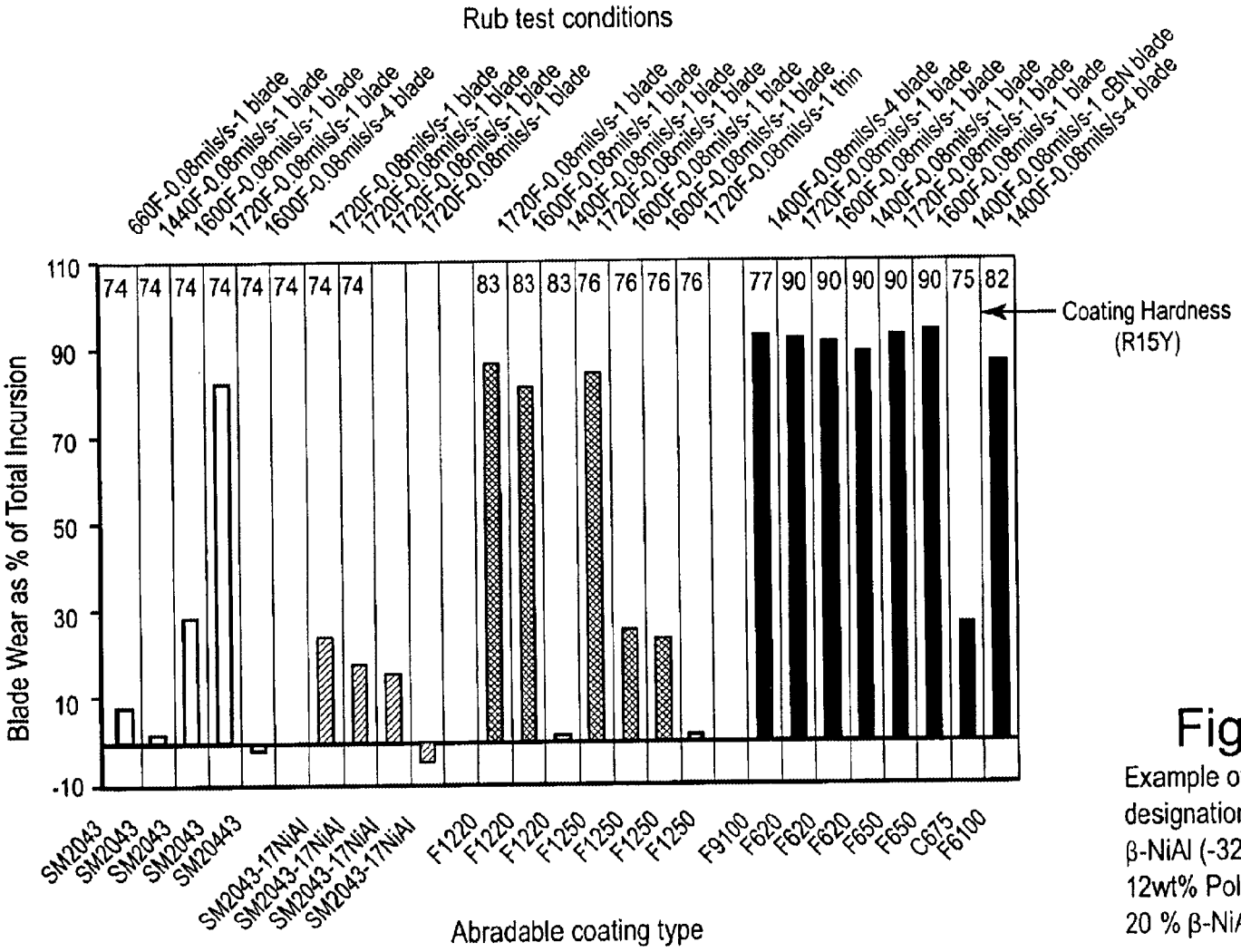
FIG. 3 is a bar chart depicting the wear of simulated blade tips as a percentage of total incursion of the bucket tips into the abradable coating for various compositions, including the prior art, at the listed test temperatures.

FIG. 3 summarizes the wear data for selected samples of coating compositions in accordance with the invention after being tested at Sulzer Innotec to determine their level of abradability as compared to conventional coatings such as Sulzer Metco SM2043. FIG. 3 shows the relative wear amounts of uncoated blade tips as compared to the total depth of incursion of the same blade into the coating. As the blade tip was forced into the coating, the amount of blade wear was measured for various coatings and at various operating temperatures.

Ideally, if a candidate coating is perfectly abradable, the amount of blade tip wear should be close to zero (indicating little or no blade wear for that particular coating). On the other hand, if the coating is not abradable, the amount of blade wear will increase and may vary depending on the operating temperature of the turbine stage.

FIG. 3 thus indicates that the best results for coating compositions according to the invention use 12% polyester (designated as "1250," where the "12" reflects 12 wt % polyester and the last two or three digits reflect the relative percent of β-NiAl in the metal component as defined above). The top horizontal legend on FIG. 3 shows the rub test conditions in terms of the test temperature, incursion rate (e.g., 0.08 mils/sec), and the number of blades. The bar graphs of Table 3 indicate that increasing the amount of β-NiAl in the coating tends to improve abradability in general and that decreasing the operating temperature tends to improve abradability with comparable coatings.

The improved abradable coating system in accordance with the present invention can be used if necessary in conjunction with reinforced bucket tips in order to provide even longer term reliability and improved operating efficiency. As shown in FIG. 3, the coating "C675" can be abraded very well with a cBN coated blade at 1400° F. Using this coating with reinforced bucket tips will provide longer reliability due to improved oxidation life as a result of reduced porosity because of the lower amount of polyester being used.

As noted above, the same abradable coatings in accordance with the invention can be applied to both new and used equipment. In repair and/or retrofit applications, the coatings on existing gas turbine engine shrouds must be physically removed after the turbine or other hot gas path components are taken out of service for routine maintenance, with the new coatings then being applied onto the metal using conventional high level bonding and coating techniques such as plasma spray.

The blade wear data chart of FIG. 3 also includes a reference to the relative hardness of the abradable coatings, including compositions in accordance with the invention (see the x-axis numbers along the line for 100% blade wear). The numbers reflect R15Y scale of the Rockwell hardness figures ranging from a low of 69.7 up to above 90, with the preferred range between about 65 and 77.

Figure 4:
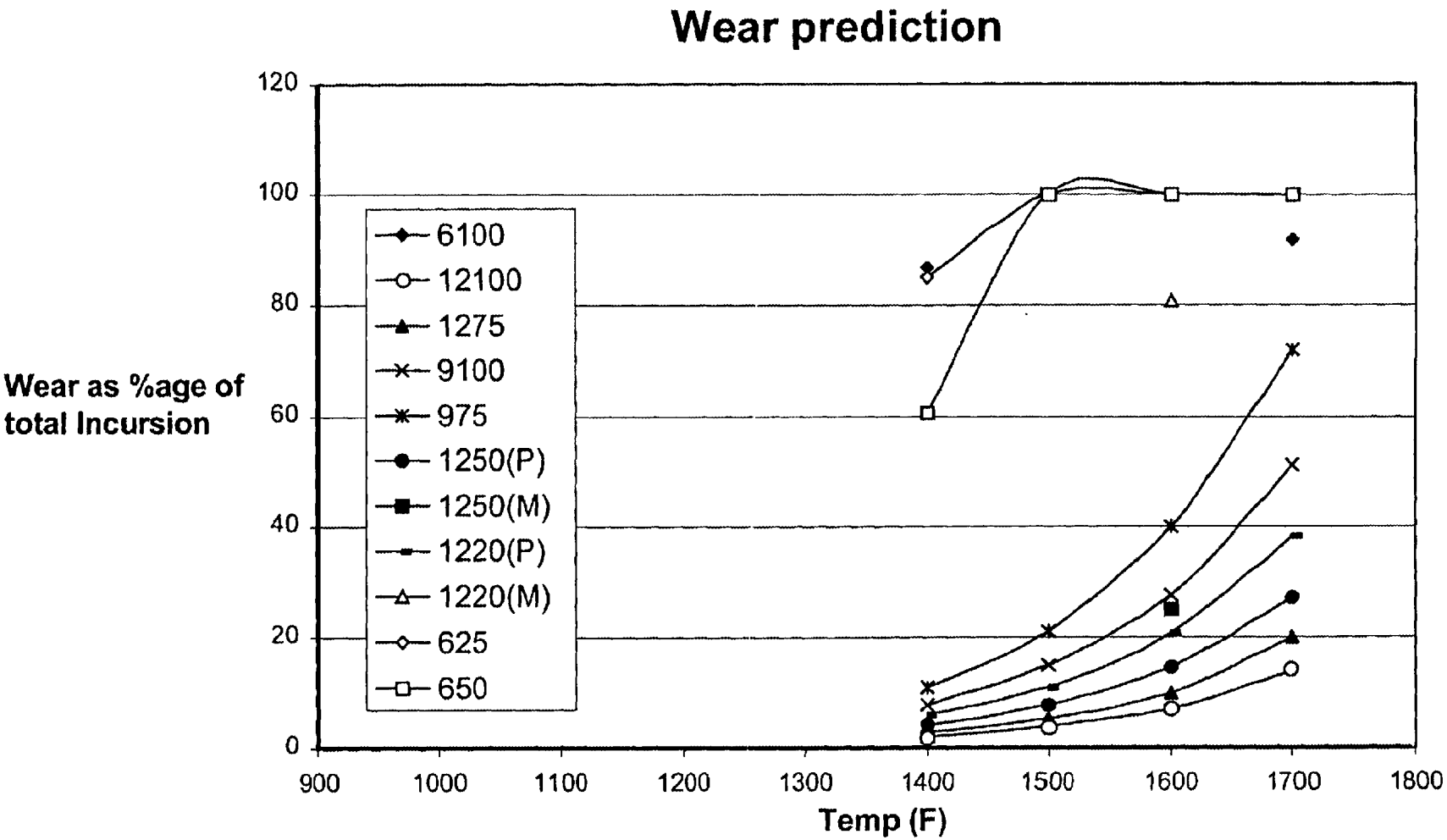
FIG. 4 is a "Wear Prediction" chart for selected abradable coatings in accordance with the invention.
Figure 5:
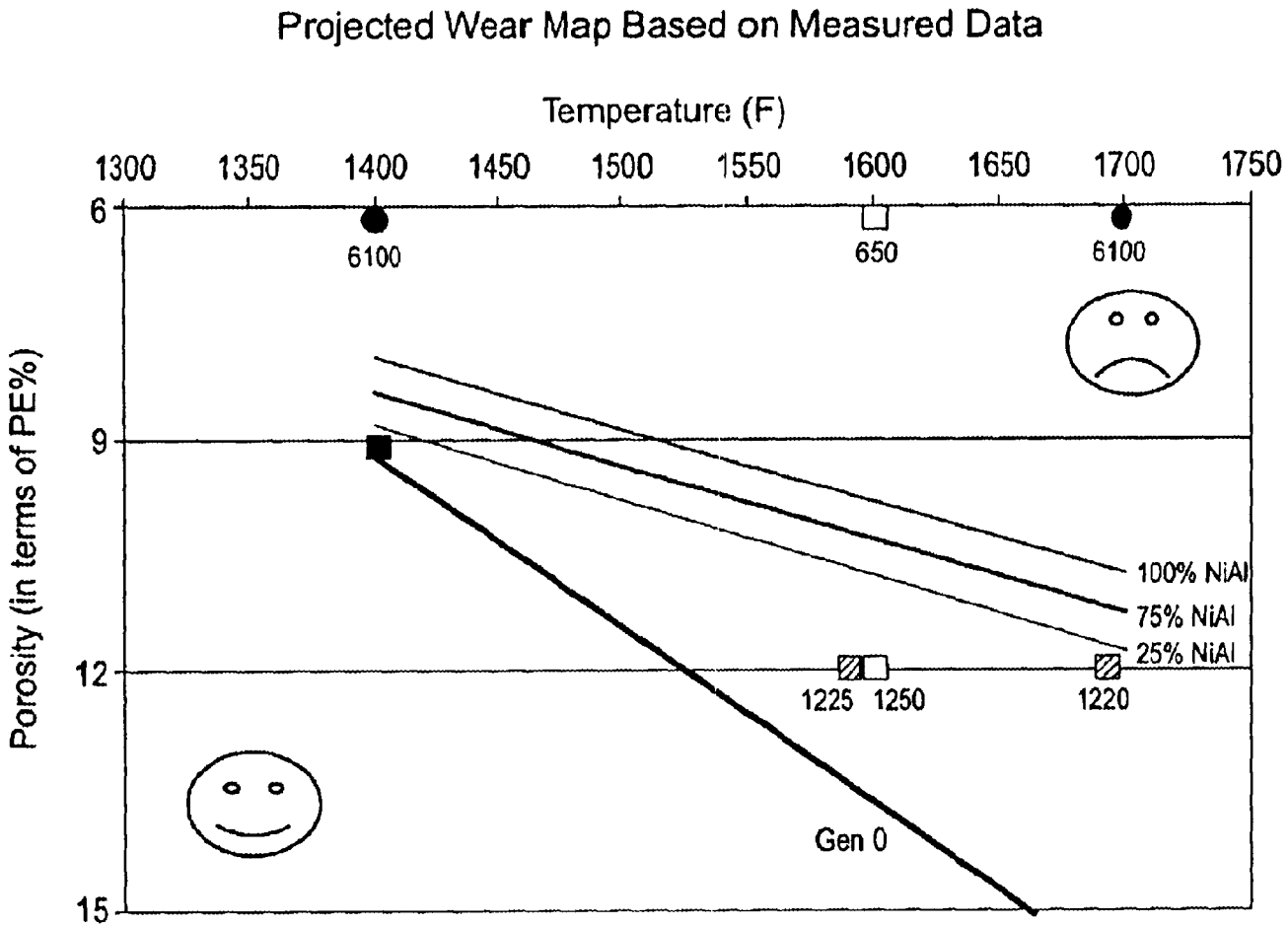
FIG. 5 is a "Projected Wear Map" based on measured data for various alternative embodiments of the new abradable coating compositions.

FIGS. 4 and 5 likewise illustrate the projected wear (based on measured empirical data) for coating compositions in accordance with the invention. The graph of FIG. 4 plots the amount of wear of uncoated blade tips as a percentage of total incursion (discussed above) and as a function of the test temperatures. The same data is shown on the "Wear Map" of FIG. 5 which shows the projected wear of the same coatings in accordance with the invention (designated by the different amounts of β-NiAl, i.e., 100%, 75%, 25% in the metallic component of the coating). FIG. 5 also plots the projected wear at given porosity levels based on the amount of polyester in the coating against the maximum operating temperature. A comparative line for the prior art coatings (with 0% β-NiAl) also appears on FIG. 5 (designated "Gen 0").

FIG. 5 illustrates that coating compositions having an equivalent porosity level above about 9% polyester will have excellent abradability (designated on FIG. 5 by a "good cutting" line) through the maximum projected test temperatures above 1700° F., as compared to the prior art ("Gen 0" refers to Sulzer Metco SM2043) Thus, based on presently available empirical data, between 9% and 12% polyester appears to define the optimum range of polyester (and hence porosity) for coatings that also include at least 25% β-NiAl in the metallic component of the coating.

Figure 6:
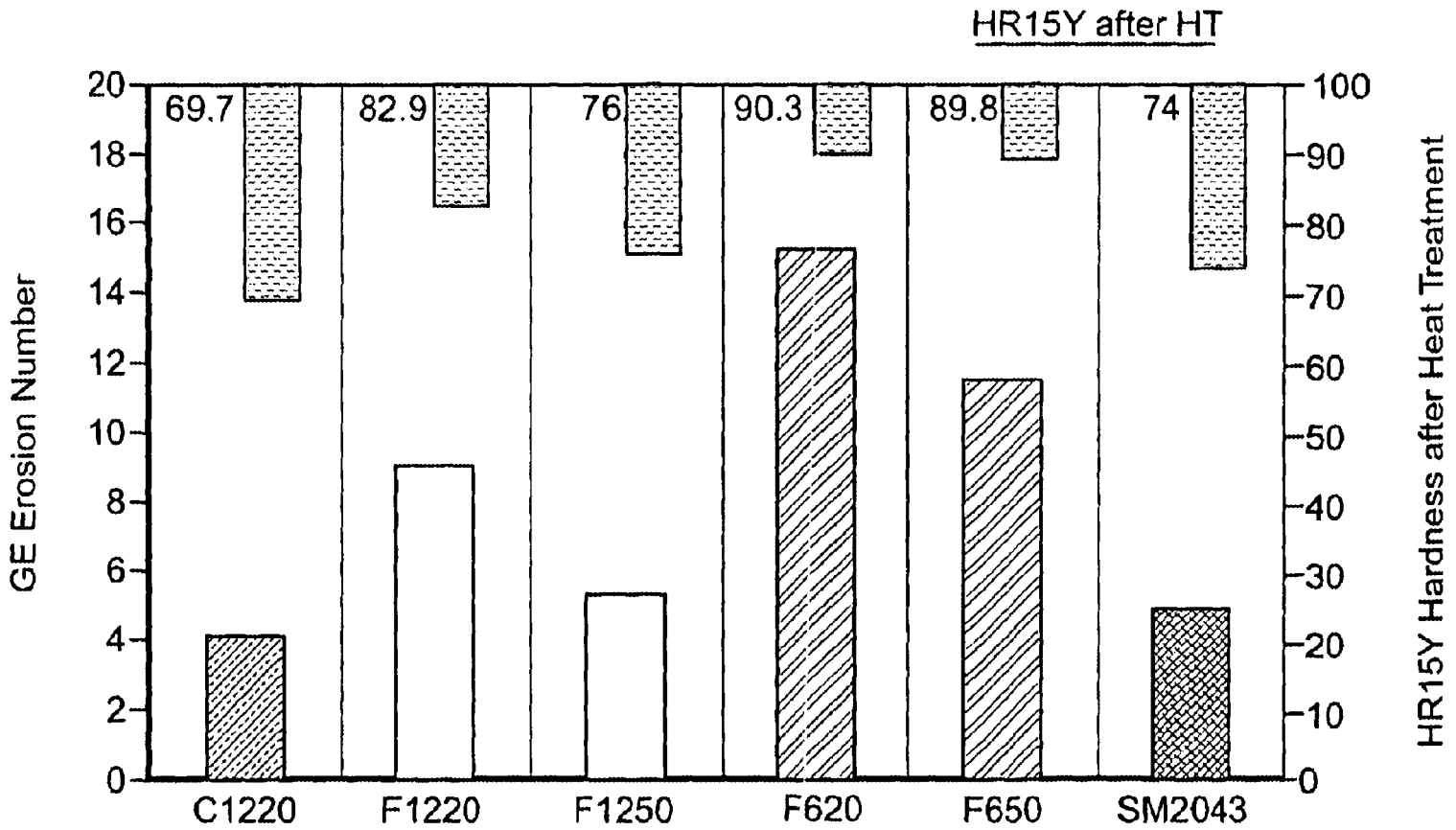
FIG. 6 is a bar chart summarizing and comparing erosion data for samples of abradable coatings using the invention with prior art coatings.

FIG. 6 includes a chart of erosion data for selected samples of abradable compositions in accordance with the invention that were deliberately eroded using a jet of hard alumina particles impacting each coating in accordance with a standard ASTM testing protocol to measure erosion levels.

The parameters and conditions for performing the erosion test in accordance with ASTMG76 are summarized as follows:

| A. Basic Test Parameters | |
|---|---|
| Air Pressure: | 28–35 psi |
| Gun Distance: | (4 ± 0.06) inches |
| Nozzle Opening: | 0.188 inches inner diameter |
| Air Jet Opening: | 0.092 inches inner diameter |
| Angle of Impingement: | (20 ± 3) degrees |
| Abrasive: | 50 microns White $Al_2O_3$ (240 mesh grit) |
| Abrasive Quantity: | (600 ± 10) grams |
| Test Standard: | Lexan (1" × 2" × 0.125" thick) |

B. Test Procedure

Measure and record the initial Lexan thickness using a dial indicator fitted with a ball attachment. Place the Lexan specimen in the test fixture under the above conditions and run until all of the abrasive has been consumed. Record the time required to consume the abrasive media. Measure and record the final thickness of the sample. Calculate the erosion number as follows:

Erosion number=Time to spray powder (in seconds)/Depth of erosion (mils)

If the erosion number falls between 5.5 and 6.5 (sec/mil), proceed to perform the same test on an individual coated panel. If the panel fails to meet the 5.5 to 6.5 range, adjust the air pressure and retest with a new Lexan panel as described in Steps 1 through 4 until the proper range is achieved. If the proper range is still not achieved, check and replace all worn system parts until proper conditions are achieved.

After testing the coated panels, repeat the Lexan standard test under the same conditions. Calculate all averages of Lexan and coated panels that are tested by using the equation in Step (4) above. The final normalized erosion number was calculated using the following formula:

Normalized Erosion number=6×(panel average)/(Lexan average)

The chart of FIG. 6 illustrates the level of coating resistance to outside particles (such as very hard, microscopic metal particulates carried by the gas turbine exhaust stream) that physically abrade the shroud coating irrespective of blade tip impact against the shroud. Thus, as one skilled in the art might expect, softer (but more abradable) coatings may suffer from excess erosion and for that reason may not be commercially effective. FIG. 6 indicates that erosion resistance decreases with increasing levels of polyester and that coatings with 12% polyester provide sufficient erosion resistance as compared with the conventional system such as Sulzer Metco SM2043, i.e., eliminating any outside particle erosion as a controlling factor in the life of the preferred abradable coatings.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A coating composition for use in forming an abradable coating on metal components of gas turbine shrouds exposed to high temperature environments, comprising about 85–88% by weight of a brittle intermetallic phase of metal aluminide containing β-NiAl in an amount sufficient to increase the oxidation resistance of said coating at temperatures in the range of about 1380° F. to 1850° F. while maintaining good abradability, and about 12–15% by weight of a fugitive polymer consisting of polyester or polyimide, said fugitive polymer being present in an mount sufficient to adjust the porosity and abradability of said coating as applied to said metal components.

2. A coating composition according to claim 1, wherein said brittle intermetallic phase consists of stoichiometric β-NiAl (68.51 Wt. % Ni and 31.49 wt. % Al).

3. A coating composition according to claim 1, wherein said abradable coating has a thickness as applied to said metal components of about 40 to 60 mils.

4. A coating composition for use in forming an abradable coating on metal components of gas turbine shrouds exposed to high temperature environments, comprising a brittle intermetallic phase of metal aluminide containing β-NiAl in an amount sufficient to increase the oxidation resistance of said coating at elevated temperatures while maintaining good abradability, a metallic oxidation resistant matrix phase consisting of MCrAlY, wherein "M" designates CoNiCrAlY, NiCoCrAlY, FeCrAlY or NiCrAlY, and a fugitive polymer present in an amount sufficient to adjust the porosity and abradability of said coating as applied to said metal components.

5. A coating composition according to claim 4, wherein said brittle intermetallic phase consists of stoichiometric β-NiAl (68.51 wt. % Ni and 31.49 wt. % Al) and is present in an effective amount of about 17 wt. %, said fugitive polymer is present in an amount of about 15 wt. % and the remainder is MCrAlY.

6. A coating composition according to claim 4, wherein said fugitive polymer consists of polyester or polyimide.

7. An abradable, oxidation resistant coating applied to metal components of gas turbine shrouds exposed to high temperature environments, comprising a laminate structure having a first dense bond coat layer with no added porosity and having a metallic oxidation-resistant alloy containing MCrAlY, wherein "M" designates CoNiCrAlY, NiCoCrAlY, FeCrAlY or NiCrAlY, and a second brittle intermetallic layer of metal aluminide containing β-NiAl in an amount sufficient to increase the oxidation resistance of said coating at temperatures in the range of about 1380° F. to 1850° F., the porosity and abradability of said second brittle intermetallic layer having been adjusted by burning off a fugitive polymer present in said brittle intermetallic layer when applied to said metal components.

8. An abradable, oxidation resistant coating according to claim 7, wherein said β-NiAl comprises about 85–88% by weight of said second brittle intermetallic layer and said fugitive polymer comprises about 12–15% by weight of said second layer.

9. An abradable, oxidation resistant coating according to claim 7, wherein said brittle intermetallic layer contains stoichiometric β-NiAl (68.51 Wt. % Ni and 31.49 wt. % Al).

10. An abradable, oxidation resistant coating according to claim 7, wherein said fugitive polymer comprises polyester or polyimide.

11. An abradable, oxidation resistant coating according to claim 7, wherein said second brittle intermetallic layer in said laminate also contains MCrAlY.

12. An abradable coating applied to metal components of gas turbine shrouds exposed to high temperature environments, comprising a brittle intermetallic phase containing β-NiAl and in an amount sufficient to increase the oxidation life of said coating at elevated temperatures and having the porosity and abradability of said brittle intermetallic phase adjusted by burning off a fugitive polymer when applied to said metal component, wherein the oxidation life of said abradable coating is determined according to the regression formula:

$$\text{Oxidation life}=exp(32.1-0.958*PE+0.0274*\text{NiAl}-0.0117*T+0.03357*PE^2),$$

wherein, "PE" is the weight % polyester in said coating; "T" is the temperature in ° F. to which the coating is exposed, "NiAl" is the wt. % β-NiAl, with the balance MCrAlY, and "Oxidation life" is the number of hours until development of coating cracks.

* * * * *